US005184475A

United States Patent [19]

Matsumi

[11] Patent Number: 5,184,475

[45] Date of Patent: Feb. 9, 1993

[54] SELF-CONTAINED AIR CONDITIONER

[75] Inventor: Hideki Matsumi, Shiga, Japan

[73] Assignee: Matsushita Electric Industrial Co., Ltd., Osaka, Japan

[21] Appl. No.: 855,142

[22] Filed: Mar. 20, 1992

Related U.S. Application Data

[63] Continuation of Ser. No. 645,755, Jan. 25, 1991, abandoned.

[30] Foreign Application Priority Data

Jan. 26, 1990 [JP] Japan ..... 2-6939

[51] Int. Cl.[5] ..... F25D 23/12

[52] U.S. Cl. ..... 62/262; 312/101; 454/201; 62/428

[58] Field of Search ..... 62/262, 427, 263, 259, 62/428; 454/280, 201, 203, 204, 277; 312/101

[56] References Cited

U.S. PATENT DOCUMENTS

| | | | |
|---|---|---|---|
| 2,655,857 | 10/1957 | Broberg | 98/40.2 |
| 2,751,760 | 6/1956 | Williams, Jr. | 62/262 |
| 2,974,680 | 3/1961 | Kreuttner | 98/101 |
| 3,385,198 | 5/1968 | Farr | 98/121.1 |
| 4,607,500 | 8/1986 | Bolton et al. | 62/262 |
| 4,869,075 | 9/1989 | Ikari et al. | 62/262 |

FOREIGN PATENT DOCUMENTS

| | | | |
|---|---|---|---|
| 0082095 | 7/1956 | Netherlands | 98/40.2 |

*Primary Examiner*—John Sollecito

*Attorney, Agent, or Firm*—Panitch Schwarze Jacobs & Nadel

[57] ABSTRACT

A self-contained air conditioner which has a body including an outer casing having a louver area, the outer casing and the louver area being molded from resin in one piece, the louver area being made of a plurality of wedge-shaped slats each having a thick base portion.

4 Claims, 7 Drawing Sheets

SELF-CONTAINED AIR CONDITIONER

CROSS-REFERENCE TO RELATED APPLICATION

This application is a continuation of copending application Ser. No. 07/645,755, filed Jan. 25, 1991 now abandoned.

BACKGROUND OF THE INVENTION

1. Field of the Invention

The present invention relates generally to a self-contained air conditioner adapted for installment to a vertically sliding window such as double-hung windows, and more particularly to a self-contained air conditioner including a casing toward the outside having a louver, wherein the casing and louver are molded in one piece from resin. Hereinafter, a louver disposed toward the outside is called the "outer louver", whereas a louver disposed toward a room is called the "inner louver". Likewise, in this specification the direction toward the outside and toward a room is called the "outer" and the "inner", respectively.

2. Description of the Prior Art

Referring to FIGS. 6 to 11, a typical example of known self-contained air conditioners will be described:

The illustrated self-contained air conditioner has a body 101 with a front grille 102. a casing 103, and a drawer-type inside unit 104 which is accommodated in the casing 103. The casing 103 of metalwork is provided with louvers 105 on the top and both sides of the body 101, wherein the louvers 105 are made by cutting as shown in FIG. 11. The body 101 is provided with a metal network 106 welded thereto on its back. The reference numerals 107 and 108 designate stays welded to the body 101 so as to strengthen it, the stays being covered with a rust preventive coating. In addition, they are covered with a thermal insulating material and a sealing material.

The inside unit 104 includes a base plate 109 of metalwork, and a bulkhead 112 for separating an outer air path 110 and an inner air path 111. The outer air path 110 has a condenser 113, a propeller fan 114, a motor 115, a motor support 116, an air guider 117, stays 118, and a compressor 119 constituting a known refrigerating cycle, and a cover 120 for covering the condenser 113. The condenser 113 is fixed to both ends of the air guider 117 by means of screws, and to the base plate 109. An inner air path 111 has an evaporator 121, a water pan 122, a scirocco fan 123, an air guider 124 for guiding air from the scirocco fan 123, a side plate 125 of the scirocco fan air guider 124, a duct 126 and a cover 127 for covering the duct 126 and strengthening the support for the bulkhead 122.

Under the arrangement mentioned above, air flows in the following pattern:

The selfcontained air conditioner sucks air through an intake section 128*a* of the front grille 102 from a room by the scirocco fan 123. The air is cooled by an evaporator 121, and is sent into the room through an outlet grille 129*a* by way of the scirocco air guider 124 and a duct 126. The air conditioner sucks outside air through an intake grille 130 by the propeller fan 114 and the sucked air is warmed by the condenser 113. The warmed air is discharged outside through the louvers 105 by way of the air guider 117.

The self-contained air conditioner is installed in the following manner:

First, an L-shaped bar 128 is fixed to the top surface of the casing 103 by means of screws. The L-shaped bar 128 is adapted for fixture to a window frame, and a C-shaped bar 128 is fixed to the bottom of the casing 103 by means of The L-shaped bar 128 and C-shaped bar 129 are provided with suitable fixtures (not shown) whereby the self-contained air conditioner is fixed to the window.

The louvers 105 described above are formed by cutting. However, the cutting method cannot shape louvers of such complicated forms as to meet the requirements for good fluid dynamics. In addition, the mechanical strength of the casing is decreased by the cuts.

SUMMARY OF THE INVENTION

The self-contained air conditioner of the present invention, which overcomes the above-discussed and numerous other disadvantages and deficiencies of the prior art, comprises a body including an outer casing having a louver area, the outer casing and the louver area being molded from resin in one piece, the louver area comprising a plurality of wedge-shaped slats each having a thick base portion.

In a preferred embodiment, each wedge-shaped slat has a round top portion.

In a preferred embodiment, the louver area covers both sides and the back of the outer casing.

Thus, the invention described herein makes possible the objectives of (1) providing a self-contained air conditioner which prevents moisture on a filter from falling onto the inner grille, (2) providing a self-contained air conditioner capable of minimizing vibration resulting from the operation of the air compressor, thereby reducing noise arising from the vibration, (3) providing a self-contained air conditioner capable of easy installation in position on the back side of the inner grille, and (4) providing a self-contained air conditioner which has a reinforced grille.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
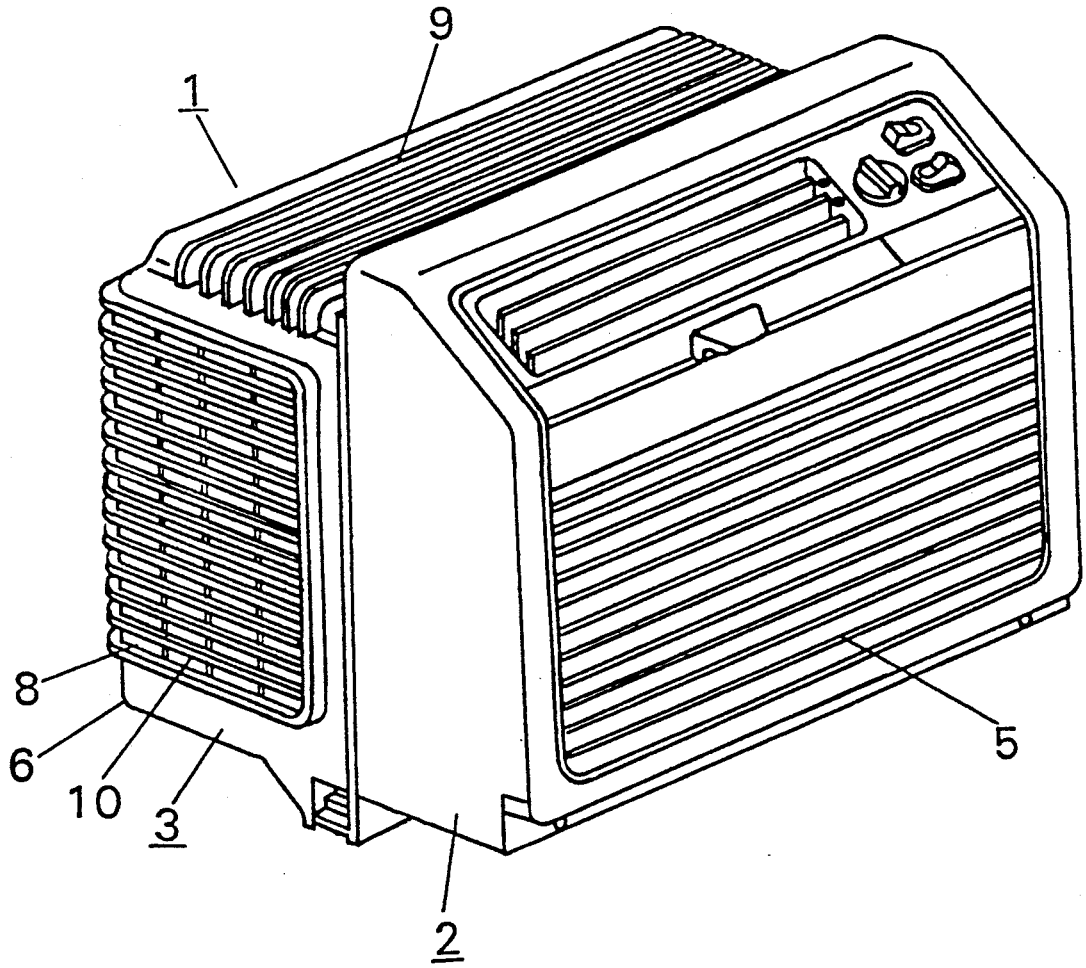
FIG. 1 is a perspective front view showing a self-contained air conditioner according to the present invention.
Figure 2:
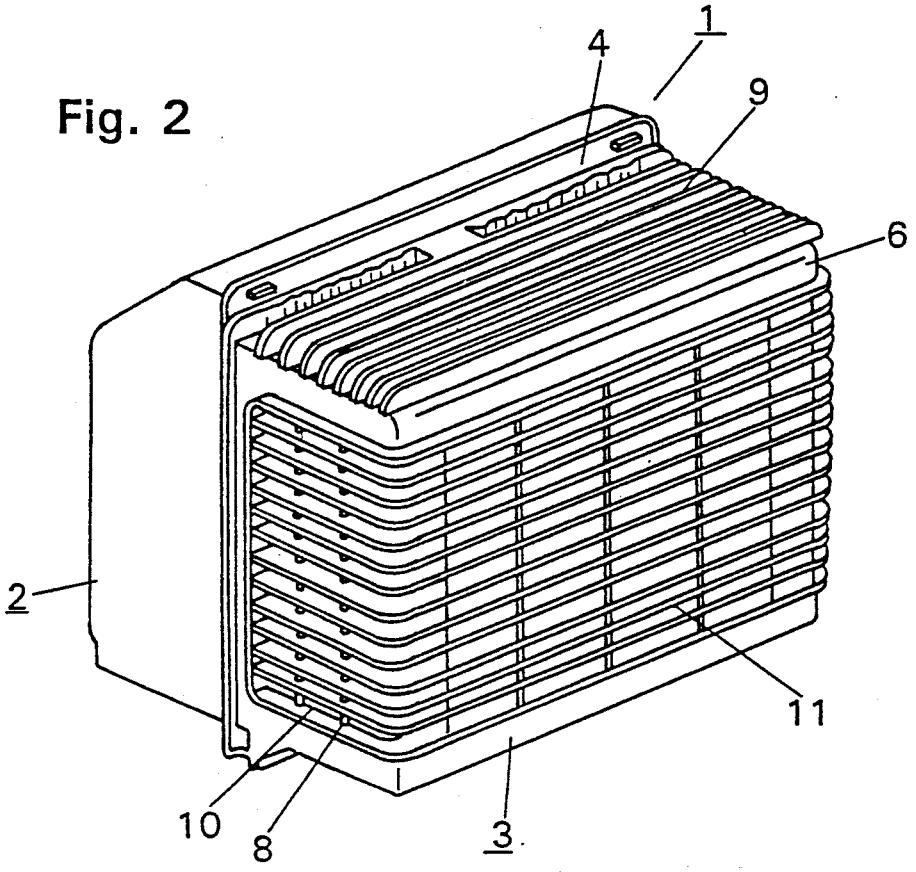
FIG. 2 is a perspective rear view showing the self-contained air conditioner of FIG. 1.

Referring to FIGS. 1 to 5, the illustrated self-contained air conditioner is provided with a body 1, which accommodates an inner grille panel 2, a frame 3, a bulkhead 4, an inner air path A and an outer air path B. The inner grille panel 2 is detachably fixed both to the bulkhead 4 and the frame 3 at the front of the body 1 and provided with a first suction intake 5. The frame 3 is made of resin, and includes a casing 6 covering the outer air path B and a base plate 7 extending to an inner grille panel 2. The casing 6 is provided with s louver area 8 in the back and both sides thereof as shown in FIG. 2. The louver area 8 strengthens the casing 6 which is provided a top louver area 9 in its top, so as to strengthen the top portion of the casing 6. The top louver area 9 includes upright slats and openings between the adjacent slats allowing air to pass. The louver area 8 constitutes an intake louver section 10 and an outlet louver section 11.

Figure 5:
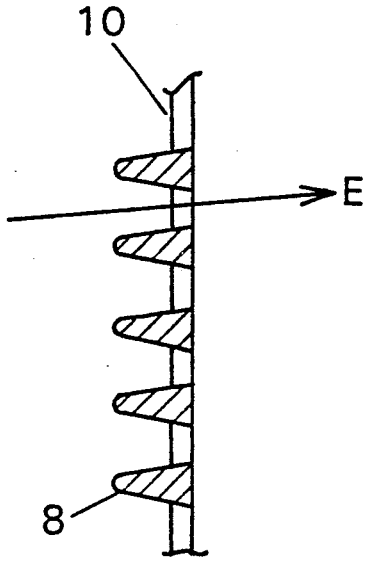
FIG. 5 is a fragmentary cross-section showing the configuration of the slats of a louver area.
Figure 6:
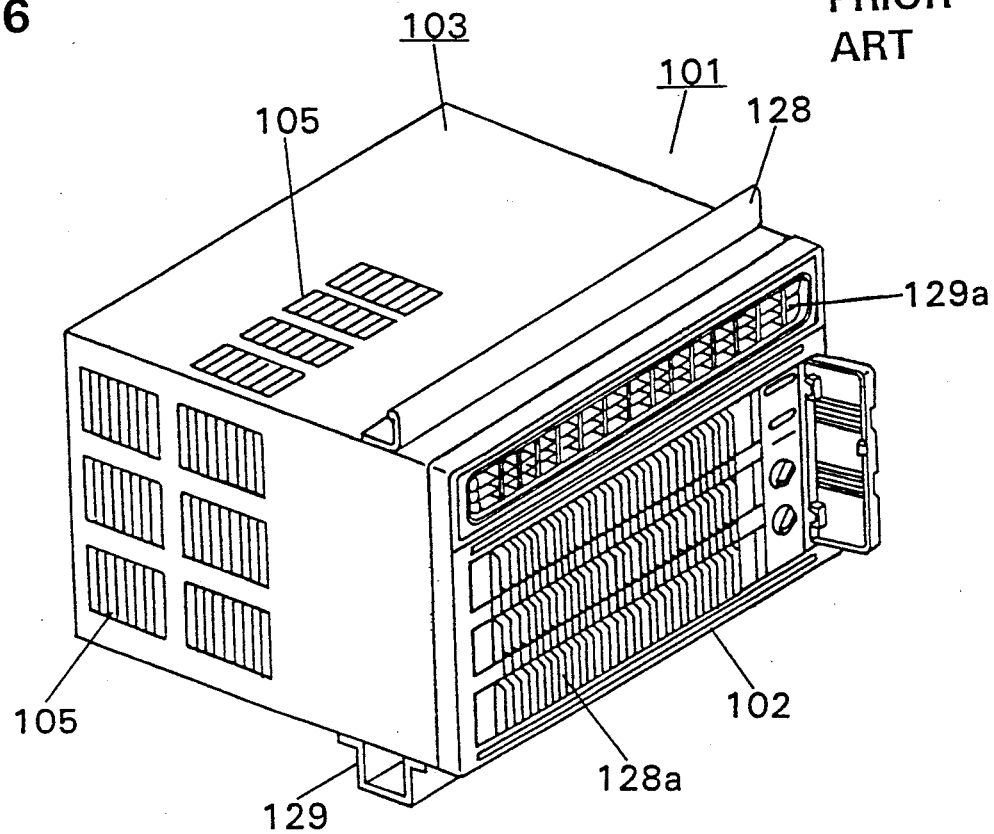
Fig. 6 PRIOR ART
FIG. 6 is a perspective front view showing a known self-contained air conditioner.
Figure 7:
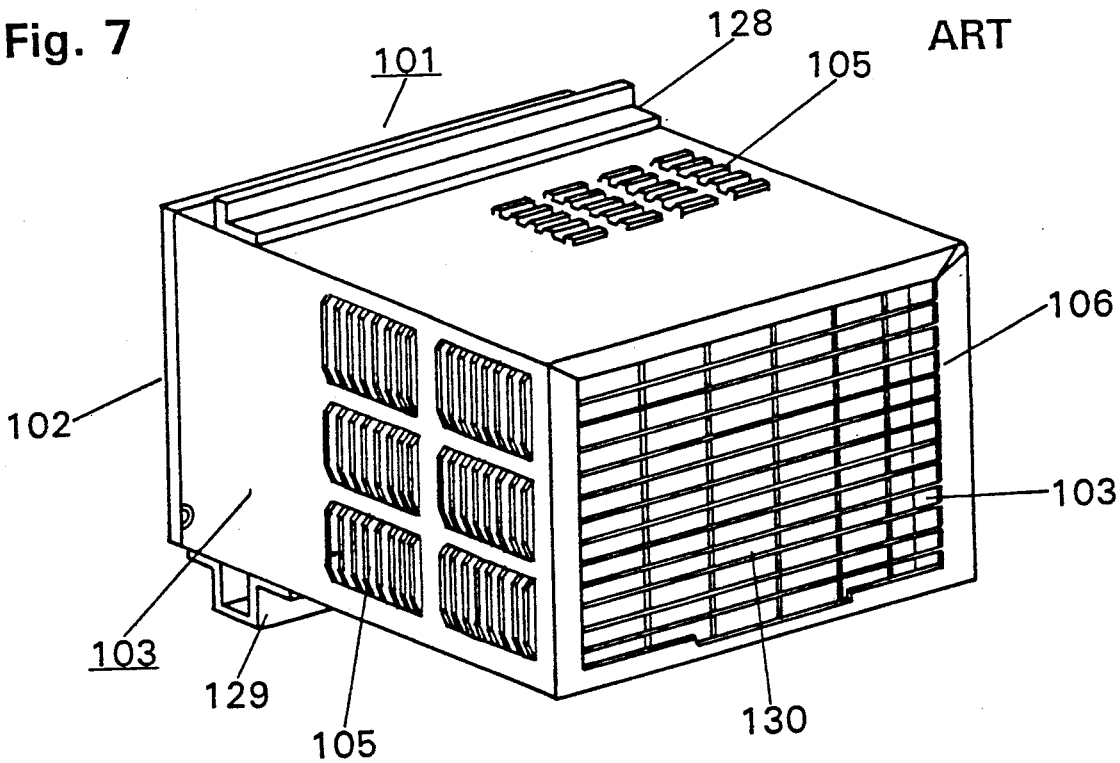
Fig. 7 PRIOR ART
FIG. 7 is a perspective rear view showing the self-contained air conditioner of FIG. 6.
Figure 8:
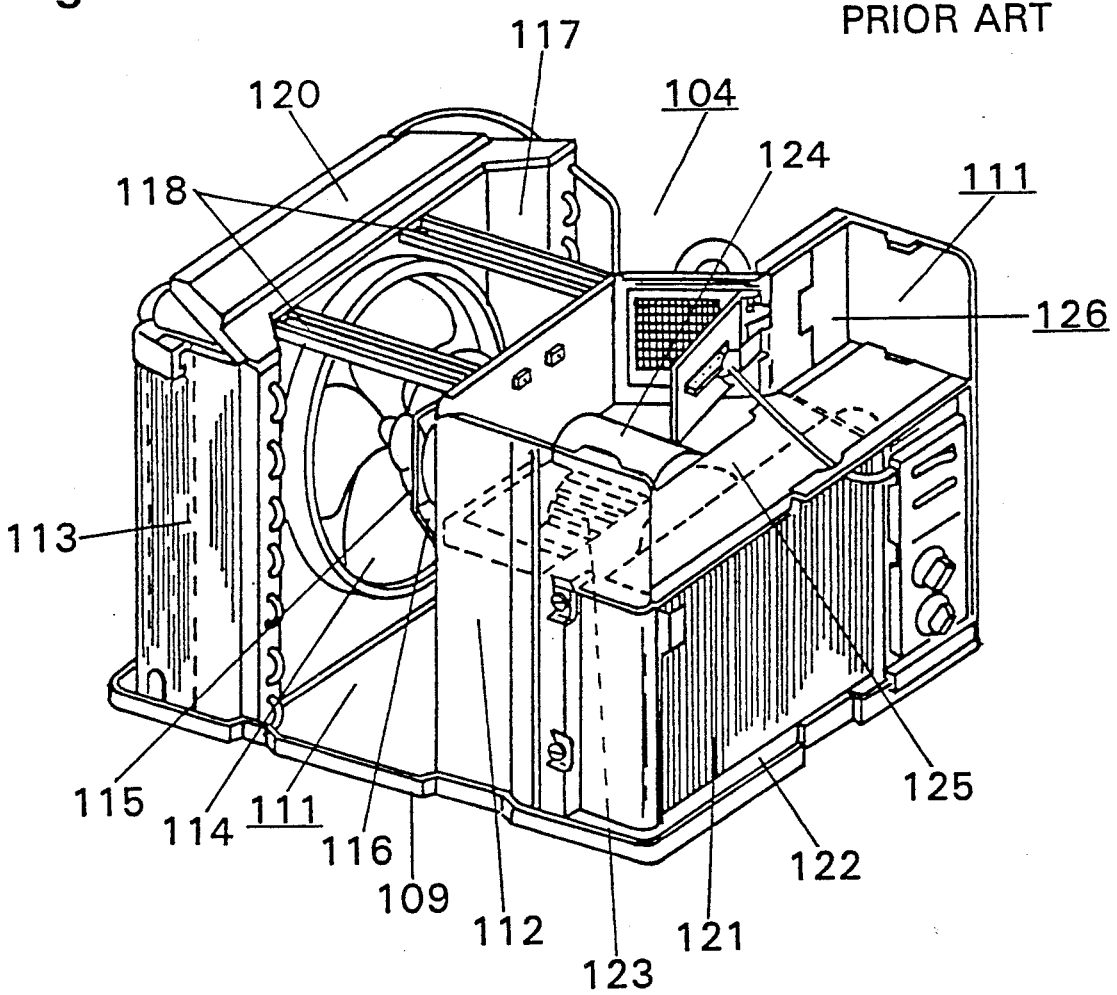
Fig. 8 PRIOR ART
FIG. 8 is a perspective front view particularly showing the internal structure of the self-contained air conditioner of FIG. 6.
Figure 9:
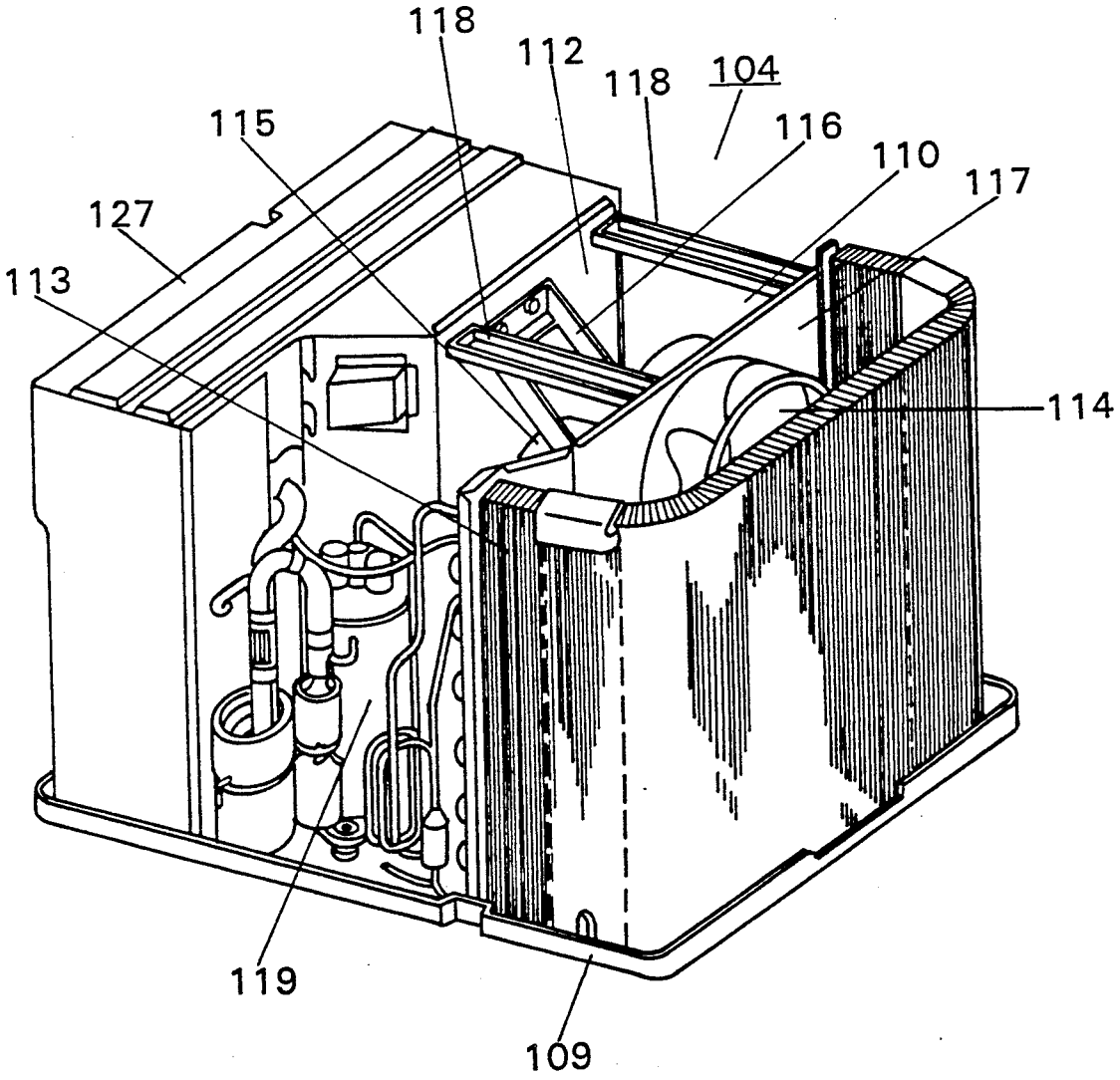
Fig. 9 PRIOR ART
FIG. 9 is a perspective rear view showing the internal structure of the known self-contained air conditioner of FIG. 6.
Figure 10:
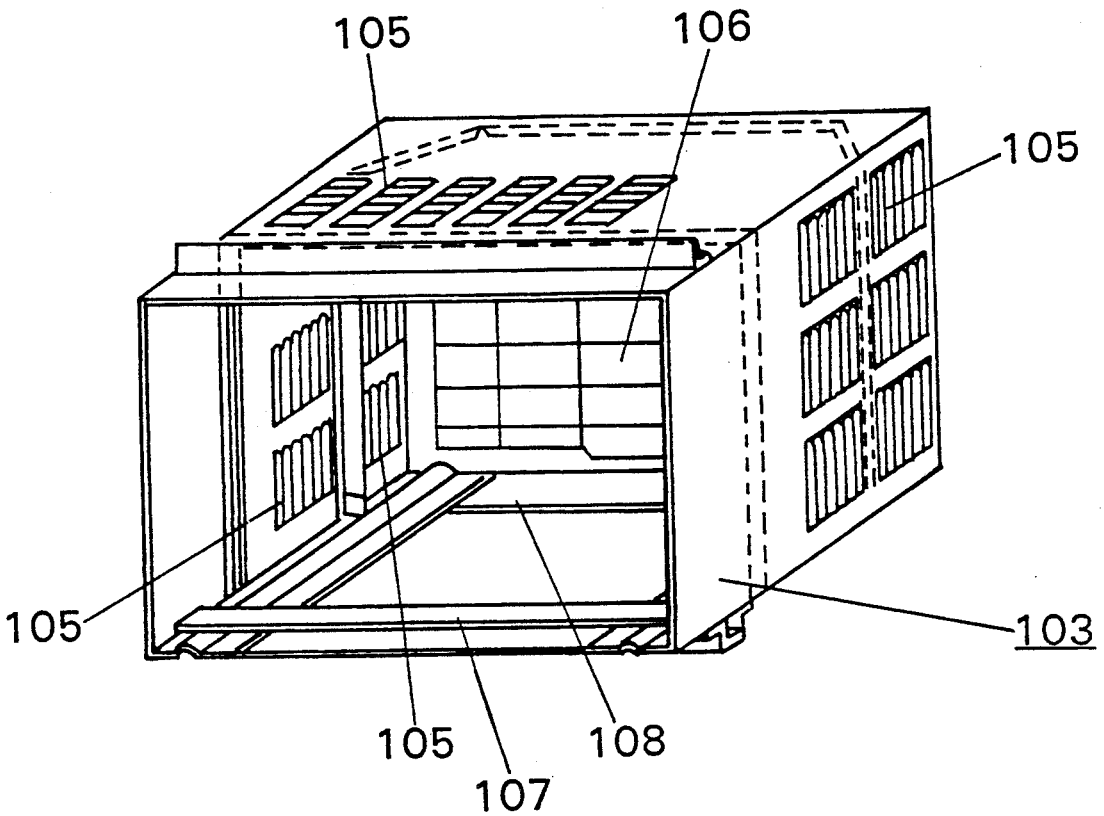
Fig. 10 PRIOR ART
FIG. 10 is a perspective view showing the casing used in the self-contained air conditioner of FIG. 6.
Figure 11:
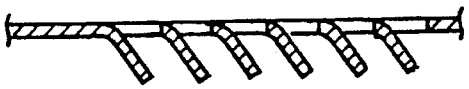
Fig. 11 PRIOR ART
FIG. 11 is a fragmentary cross-sectional view showing the louver area used in the known self-contained air conditioner of FIG. 6.

As shown in FIG. 5, each slat of the louver area 8 is wedge-shaped so as to have a thick base portion toward the body 1 and a round top portion toward the outside. The outer air path B includes a condenser 12 located in opposition to the outlet 11, a propeller fan 13 for blowing air so as to dissipate heat from the condenser 12 and disperse moisture on the base plate 7, the propeller fan 13 being equipped with a slinger ring, a motor 14 screwed to the bulkhead 4 so as to drive the propeller fan 13, an air guider 15, a cover 16 for covering a lead line connected to the motor 14, a compressor 17, and piping (not numbered).

Figure 3:
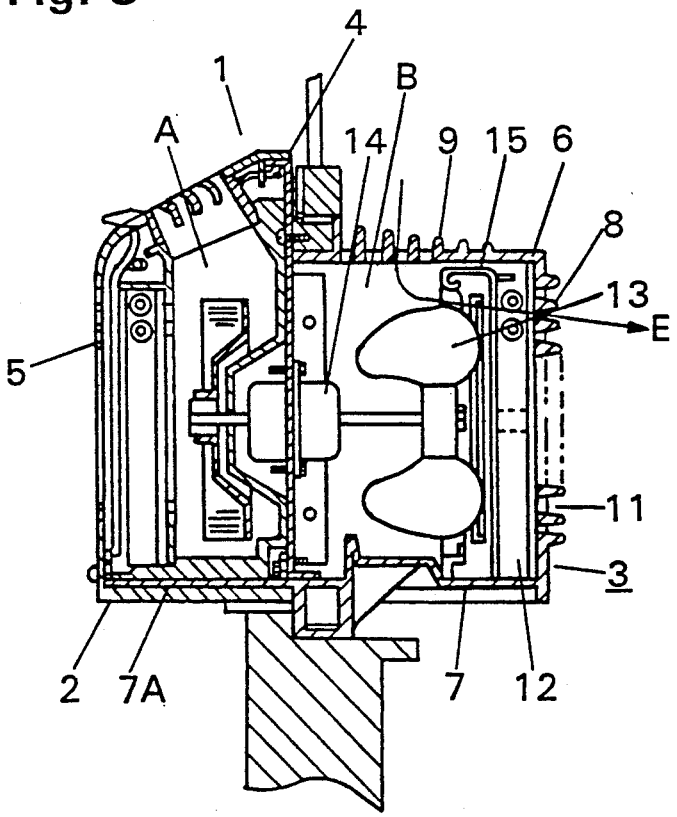
FIG. 3 is a vertical cross-sectional view taken through the self-contained air conditioner of FIG. 2.
Figure 4:
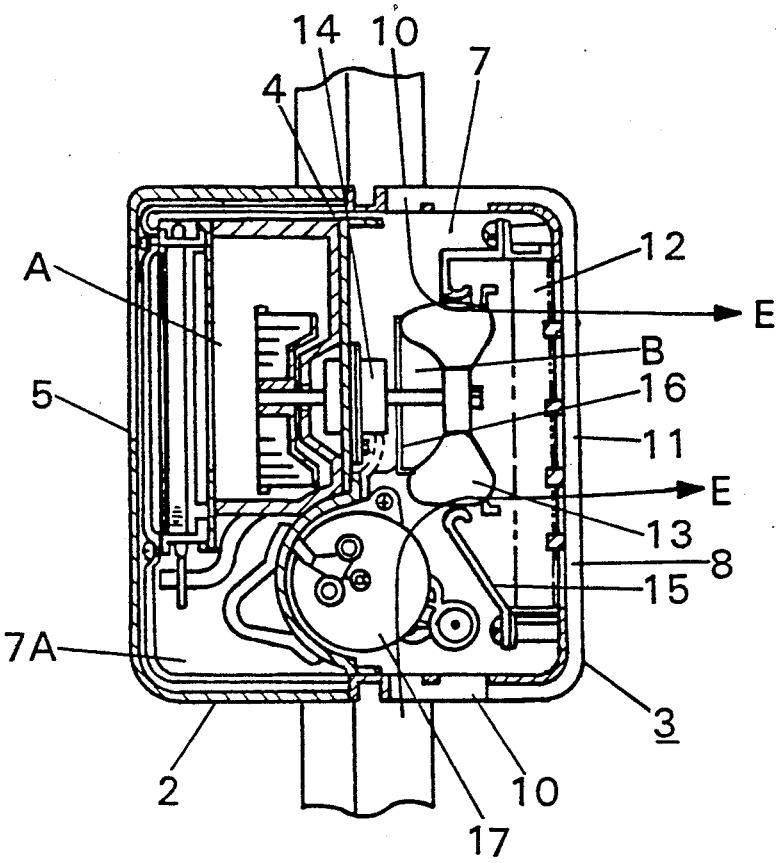
FIG. 4 is a horizontal cross-sectional view taken through the self-contained air conditioner of FIG. 2.

The flow pattern of air under the arrangement specified above will be described:

In FIG. 3 the flow of air is indicated by the arrow E. More specifically, outside air is introduced into the body 1 through the top louver area 9 and intake louver section 10 by the propeller fan 13. The sucked air is warmed by the condenser 12, and discharged outside through the outlet 11 by way of the air guider 15. Owing to the open entry formed by the wedge-shaped slats of the top louver area 9 and the intake louver section 10, the air is smoothly introduced into the body 1 without meeting any substantial resistance, and is gradually orientated in an optimum direction of flow. The round tops of the slats lessen the collision of the air with the slats of the louvers, thereby minimizing airy turbulence and resistance to the flow of air throughout the body 1.

As is evident from the above description, the louver areas according to the present invention have many advantages such as the follows:

The louver area is made of resin in one piece with the casing, wherein each slat of the louver area is wedge-shaped so as to be thick in its base portion, the base portion thereby being located downstream of intake air flowing through the slats, and round on its top portion so that intake air is smoothly introduced into the body of the air conditioner with a minimum resistance, and guided so as to facilitate the suction. The round tops of the slats lessen violent collision of air with the slats, thereby minimizing the disturbance of air flow and resistance to the air flow. Thus, the air conditioner has a good circulation of intake air. Because of the unity of the louver areas and the body, and the provision of the louver areas in the opposite sides and back of the casing, the body is reinforced to have sufficient mechanical strength. This reinforcement compensates for the slatted openings in the louver areas.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A self-contained air conditioner comprising a body including an outer casing having sides, a back and a louver area, the outer casing and the louver area which covers the sides and back of the outer casing being molded from resin in one piece so as to strengthen the outer casing, the louver area comprising a plurality of wedge-shaped slats, each slat being continuous along each side and the back of the outer casing, each slat having thick base portion, the base portion of the slats of the sides being located downstream of air flowing through the slats and the base portion of the slats of the back being located upstream of air flowing through the slats.

2. A self-contained air conditioner according to claim 1, wherein each wedge-shaped slat has a round top portion.

3. A self-contained air conditioner comprising a body including an outer casing having sides, a back ana louver area, the outer casing and the louver area being molded from resin in one piece so as to strengthen the outer casing, the louver area comprising a the louver area comprising a top louver area and an intake louver section for introducing air into the body and an outer louver section for discharging air from the body, the intake louver section and the outlet louver section covering the sides and back of the outer casing, the louver area comprising a plurality of wedge-shaped slates, each slat having a thick base portion, each slat of the intake louver section and the outlet louver section being continuous along each side nd the back of the outer casing, the base portion of the slats of the intake louver section being located downstream of air flowing through the slats and the base portion of the slats of the outlet louver section being located upstream of air flowing through the slats.

4. The self-contained air conditioner according to claim 3, wherein each wedge-shaped slat has a thick base portion proximate the body and a round top portion distal to the body.

* * * * *

UNITED STATES PATENT AND TRADEMARK OFFICE

CERTIFICATE OF CORRECTION

PATENT NO. : 5,184,475

DATED : February 9, 1993

INVENTOR(S) : Hideki Matsumi

It is certified that error appears in the above-identified patent and that said Letters Patent is hereby corrected as shown below:

In Column 2, line 6, delete "128" after "C-shaped bar" and insert therefor --129--.

In Column 2, line 7, after "by means of" insert --screws.--

Col. 4, line 32
In claim 1, line 9, after "having" insert --a--.

Col. 4, line 41 In claim 3, line 2, delete "ana" and insert therefor --and--.

Col. 4, lines 44-45
In claim 3, lines 5 and 6, delete "a the louver area comprising".

Col. 4, line 53
In claim 3, line 14, delete "nd" and insert therefor --and--.

UNITED STATES PATENT AND TRADEMARK OFFICE

CERTIFICATE OF CORRECTION

PATENT NO. : 5,184,475

DATED : February 9, 1993

INVENTOR(S) : Hideki Matsumi

It is certified that error appears in the above-indentified patent and that said Letters Patent is hereby corrected as shown below:

Col. 4, line 59

In claim 4, line 1, delete "The" and insert therefor --A--.

Signed and Sealed this

Twenty-eighth Day of December, 1993

*Attest:*

*Attesting Officer*

BRUCE LEHMAN

*Commissioner of Patents and Trademarks*